US011433983B1

(12) United States Patent
Gable et al.

(10) Patent No.: US 11,433,983 B1
(45) Date of Patent: Sep. 6, 2022

(54) SYSTEM AND METHOD FOR MANEUVERING MARINE VESSEL WITH NON-ENGINE-POWERED PROPULSION DEVICE

(71) Applicant: Brunswick Corporation, Mettawa, IL (US)

(72) Inventors: Kenneth G. Gable, Oshkosh, WI (US); Andrew J. Przybyl, Berlin, WI (US); Steven M. Anschuetz, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 451 days.

(21) Appl. No.: 16/737,009

(22) Filed: Jan. 8, 2020

Related U.S. Application Data

(62) Division of application No. 16/050,588, filed on Jul. 31, 2018, now Pat. No. 10,562,602.

(51) Int. Cl.
*B63H 25/42* (2006.01)
*B63H 25/02* (2006.01)
(Continued)

(52) U.S. Cl.
CPC ..... *B63H 25/42* (2013.01); *B63H 25/02* (2013.01); *B63H 25/46* (2013.01); *B63H 11/04* (2013.01); *B63H 2025/026* (2013.01)

(58) Field of Classification Search
CPC ..... B63H 25/42; B63H 25/02; B63H 25/46; B63H 11/04; B63H 2025/026
(Continued)

(56) References Cited

U.S. PATENT DOCUMENTS 3,675,611 A 7/1972 Glass
5,016,553 A 5/1991 Spencer
(Continued)

FOREIGN PATENT DOCUMENTS

EP 1970302 B1 9/2008
JP H08192794 A 7/1996
(Continued)

OTHER PUBLICATIONS

Kaushik, Mohit, "Bow Thrusters: Construction and Working", article in Marine Insight, last updated Jun. 22, 2018, available at https://www.marineinsight.com/tech/bow-thrusters-construction-and-working/, retrieved on Jun. 25, 2018.
(Continued)

*Primary Examiner* — Anthony D Wiest
(74) *Attorney, Agent, or Firm* — Andrus Intellectual Property Law, LLP

(57) ABSTRACT

A marine propulsion system includes an engine-powered propulsion device coupled in torque-transmitting relationship with an engine. A non-engine-powered propulsion device is coupled to a source of electric or hydraulic power. A control module is provided in signal communication with the engine-powered propulsion device and the non-engine-powered propulsion device. A user-operated input device is in signal communication with the control module. The marine propulsion system operates in a non-engine-powered propulsion mode in response to the control module determining the following: the engine was previously running; a speed of the engine is below an engine-stopped speed threshold; the marine propulsion system is on; and a request for movement of the vessel has been input via the user-operated input device. While the marine propulsion system operates in the non-engine-powered propulsion mode, the control module controls the non-engine-powered propulsion
(Continued)

device to generate thrust to maneuver the vessel according to the request for movement.

20 Claims, 3 Drawing Sheets

(51) Int. Cl.
*B63H 25/46* (2006.01)
*B63H 11/04* (2006.01)

(58) Field of Classification Search
USPC ..... 701/21; 440/1, 3, 5, 6, 66–68, 79, 84, 440/86, 87
See application file for complete search history.

(56) References Cited

U.S. PATENT DOCUMENTS

| | | | | |
|---|---|---|---|---|
| 6,079,346 | A | 6/2000 | Kooren | |
| 6,273,771 | B1 | 8/2001 | Buckley et al. | |
| 7,121,219 | B1 | 10/2006 | Stallings | |
| 7,500,890 | B2 | 3/2009 | Morvillo | |
| 7,972,187 | B2 | 7/2011 | Morvillo | |
| 8,192,269 | B2 | 6/2012 | Yacenda | |
| 8,682,515 | B2 * | 3/2014 | Ito | B63H 21/213 701/99 |
| 8,858,278 | B2 | 10/2014 | Morvillo | |
| 8,965,606 | B2 * | 2/2015 | Mizutani | B63H 21/22 701/21 |
| 9,132,903 | B1 | 9/2015 | Gable et al. | |
| 9,434,460 | B1 | 9/2016 | Samples et al. | |
| 9,988,134 | B1 | 6/2018 | Gable et al. | |
| 2010/0248560 | A1 | 9/2010 | Ito et al. | |
| 2015/0220104 | A1 | 8/2015 | Morvillo | |

FOREIGN PATENT DOCUMENTS

| | | | |
|---|---|---|---|
| WO | 2000013967 | A1 | 3/2000 |
| WO | 2002085702 | A1 | 10/2002 |
| WO | 2017202458 | A1 | 11/2017 |

OTHER PUBLICATIONS

Mercury Marine, "Joystick Piloting for Inboards—Single or Dual Engines", Operation Manual, 2016, pp. 2-4, 12-15.
Mercury Marine, "Joystick Piloting for Inboards", Brochure, Sep. 2016.
Mercury Marine, "Mercury Marine Expands Joystick Technology to Tow Sports Boats", web article, Jan. 9, 2017, available at https://www.mercurymarine.com/en/us/news/mercury-marine-expands-joystick-technology-to-tow-sports-boats/, retrieved on Jun. 25, 2018.
Gable et al., "System and Method for Maneuvering Marine Vessel with Non-Engine-Powered Propulsion Device," Unpublished U.S. Appl. No. 16/050,588, filed Jul. 31, 2018.

* cited by examiner

SYSTEM AND METHOD FOR MANEUVERING MARINE VESSEL WITH NON-ENGINE-POWERED PROPULSION DEVICE

CROSS-REFERENCE TO RELATED APPLICATION

The present application is a division of U.S. application Ser. No. 16/050,588, filed Jul. 31, 2018, which is hereby incorporated by reference herein in its entirety.

FIELD

The present disclosure relates to marine vessels equipped with both engine-powered propulsion devices and non-engine-powered propulsion devices.

BACKGROUND

U.S. Pat. No. 6,273,771, which is incorporated herein by reference in entirety, discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

U.S. Pat. No. 9,132,903, which is incorporated herein by reference in entirety, discloses systems and methods for maneuvering a marine vessel having a plurality of steerable propulsion devices. The plurality of propulsion devices are controlled to achieve a lateral movement by controlling the steering orientation of port and starboard propulsion devices so that forward thrusts provided by the port and starboard propulsion devices intersect at or forwardly of a center of turn of the marine vessel. One of the port and starboard propulsion devices is operated to provide a forward thrust and the other of the port and starboard propulsion devices is operated to provide a reverse thrust so that the lateral movement is achieved and a resultant yaw component is applied on the marine vessel. An intermediate propulsion device is controlled to apply an opposing yaw component on the marine vessel that counteracts the resultant yaw component.

U.S. Pat. No. 9,434,460, which is incorporated herein by reference in entirety, discloses systems for maneuvering a marine vessel comprising an input device for requesting lateral movement of the marine vessel with respect to the longitudinal axis and a plurality of propulsion devices including at least a port propulsion device, a starboard propulsion device and an intermediate propulsion device disposed between the port and starboard propulsion devices. A control circuit controls orientation of the port and starboard propulsion devices inwardly towards a common point on the marine vessel, and upon a request for lateral movement of from the input device, operates one of the port and starboard propulsion devices in forward gear, operates the other of the port and starboard propulsion devices in reverse gear, and operates the intermediate propulsion device in reverse gear.

U.S. Pat. No. 9,988,134, which is incorporated herein by reference in entirety, discloses systems and methods for controlling movement of a marine vessel extending along a longitudinal axis between a bow and a stern and along a lateral axis between a port side and a starboard side, having a first propulsion device located closer to the stern than to the bow and steerable about a first steering axis perpendicular to the longitudinal and lateral axes, a second propulsion device located closer to the bow than to the stern and steerable about a second steering axis perpendicular to the longitudinal and lateral axes. An input device is configured to input a request for movement of the marine vessel. A control module is configured to control steering and thrust of the first and second propulsion devices to achieve a resultant movement of the marine vessel commensurate with the request for movement.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one example of the present disclosure, a marine propulsion system for a marine vessel includes an engine-powered propulsion device coupled in torque-transmitting relationship with an engine. A non-engine-powered propulsion device is coupled to a source of electric or hydraulic power. A control module is provided in signal communication with the engine-powered propulsion device and the non-engine-powered propulsion device. A user-operated input device is in signal communication with the control module. The marine propulsion system operates in a non-engine-powered propulsion mode in response to the control module determining the following: the engine was previously running; a speed of the engine is below an engine-stopped speed threshold; the marine propulsion system is on; and a request for movement of the vessel has been input via the user-operated input device. While the marine propulsion system operates in the non-engine-powered propulsion mode, the control module controls the non-engine-powered propulsion device to generate thrust to maneuver the vessel according to the request for movement.

According to another example of the present disclosure, a method for maneuvering a marine vessel powered by a marine propulsion system including an engine-powered propulsion device and a non-engine-powered propulsion device is described. The method is carried out by a control module and includes receiving a stop command to stop a running engine powering the engine-powered propulsion device. The method includes determining if the marine propulsion system is on. The method also includes receiving a request for movement of the vessel from a user-operated input device in signal communication with the control module. The method next includes enabling a non-engine-powered propulsion mode in response to receiving the request for movement after receiving the stop command and while the marine propulsion system is on. While in the non-engine-powered propulsion mode, the method includes controlling the non-engine-powered propulsion device to generate thrust to maneuver the vessel according to the request for movement.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
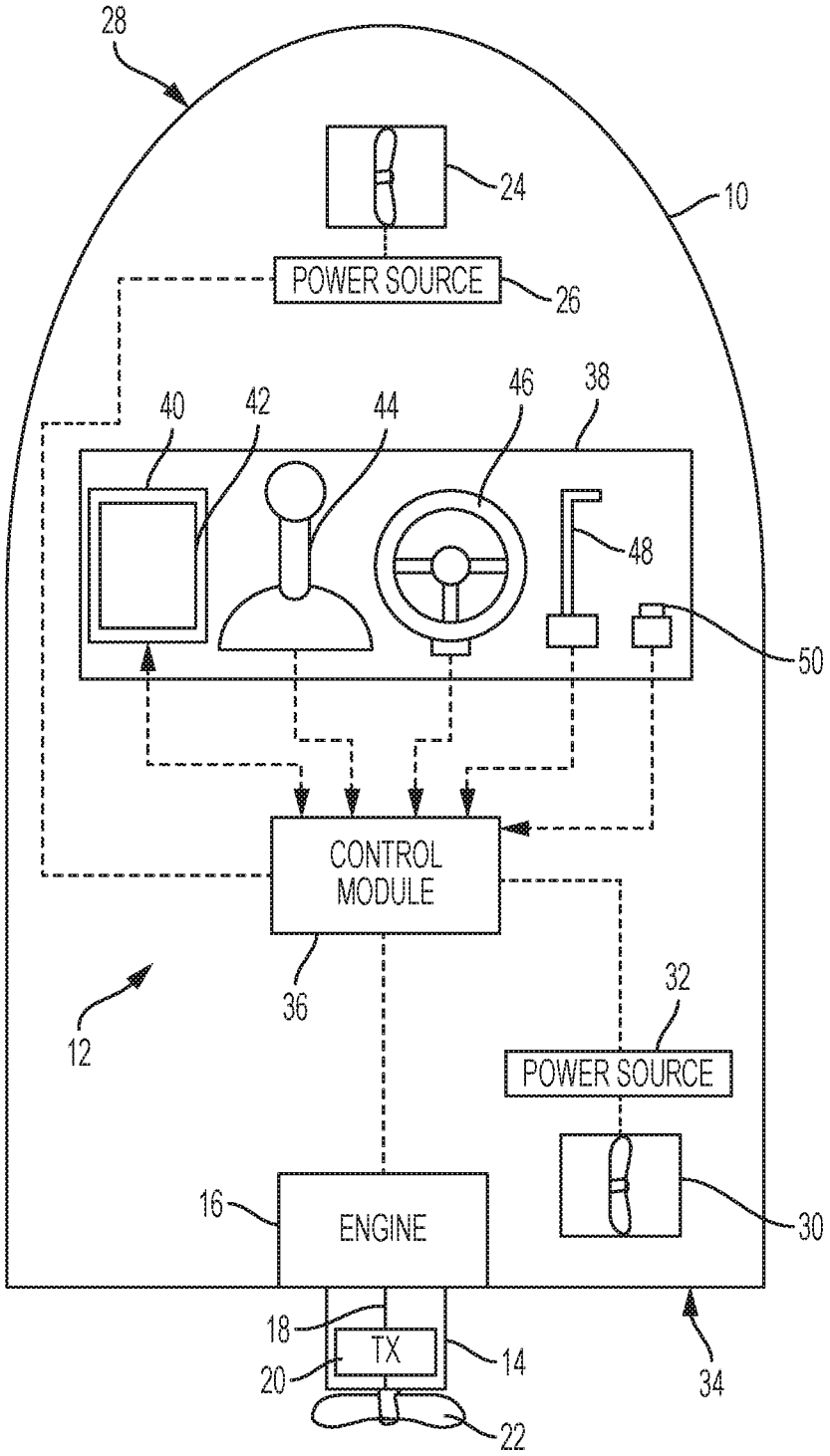
FIG. 1 is a schematic illustrating a marine vessel including a marine propulsion system according to the present disclosure.

FIG. 1 illustrates a marine vessel 10 including a marine propulsion system 12. The marine propulsion system 12 includes an engine-powered propulsion device 14 coupled in torque-transmitting relationship with an engine 16. In the example shown herein, the engine-powered propulsion device 14 is an inboard motor; however, the engine-powered propulsion device 14 could instead be an outboard motor, a stern drive, a pod drive, or a jet drive. Additionally, as is known, more than one engine-powered propulsion device could be provided. As shown, an output shaft 18 of the engine 16 is connected via a transmission 20 to a propeller 22 of the engine-powered propulsion device 14. However, other torque-transmitting arrangements could be provided. The marine propulsion system 12 also includes a non-engine-powered propulsion device 24 coupled to a source 26 of electric or hydraulic power. In the present example, the marine propulsion system 12 includes a non-engine-powered propulsion device 24 located at the bow 28 of the vessel 10 and another non-engine-powered propulsion device 30 coupled to a source 32 of electric or hydraulic power located at the stern 34 of the vessel 10. In the present example, the non-engine-powered propulsion devices are therefore a bow thruster 24 and a stern thruster 30. In other examples, only a bow thruster or a stern thruster is provided. In still other examples, multiple thrusters are provided at the bow 28 and/or stern 34, and/or thrusters are provided elsewhere on the vessel 10.

The exact type of thruster is not limiting on the scope of the present disclosure. As is known to those having ordinary skill in the art, bow and stern thrusters can be externally mounted, mounted in tunnels extending laterally through the hull of the vessel 10, or extendable out of and retractable into the hull. The thrusters can be steerable so as to vary a direction of thrust of the respective thruster, or can be fixed in place. The thrusters can be conventional propeller or impeller thrusters or water jet thrusters. The thrusters can produce thrust in two different directions, such as by varying the direction of rotation of their propellers or impellers or the direction of water discharged through their nozzles. The thrusters can be powered by an electric motor or by a hydraulic pump-motor system. For example, if the power source 26, 32 is an electric motor, it includes an output shaft, gear set, or transmission that rotates the propeller or impeller shaft of the non-engine-powered propulsion device 24, 30 or the pump shaft of a water pump. If the power source 26, 32 is a hydraulic pump-motor system, it includes an electric pump and reservoir/tank and may include cooling and filtration components. The above-described types of thrusters are well known in the art and therefore will not be described further herein.

The marine propulsion system 12 also includes a control module 36 in signal communication with the engine-powered propulsion device 14 and the non-engine-powered propulsion devices 24, 30. The control module 36 is programmable and includes a processor and a memory. The control module 36 can be located anywhere in the marine propulsion system 12 and/or located remote from the marine propulsion system 12 and can communicate with various components of the vessel 10 via a peripheral interface and wired and/or wireless links, as will be explained further herein below. Although FIG. 1 shows one control module, the marine propulsion system 12 can include more than one control module. Portions of the method disclosed herein below can be carried out by a single control module or by several separate control modules. For example, the marine propulsion system 12 can have control modules located at or near a helm of the vessel 10 and can also have control modules located at or near the engine-powered propulsion device 14 and/or the non-engine-powered propulsion devices 24, 30. If more than one control module is provided, each can control operation of a specific device or sub-system on the vessel 10.

In some examples, the control module 36 may include a computing system that includes a processing system, storage system, software, and input/output (I/O) interfaces for communicating with peripheral devices. The systems may be implemented in hardware and/or software that carries out a programmed set of instructions. For example, the processing system loads and executes software from the storage system, such as software programmed with a method for switching between an engine-powered propulsion mode and a non-engine-powered propulsion mode, which directs the processing system to operate as described herein below in further detail. The computing system may include one or more processors, which may be communicatively connected. The processing system can comprise a microprocessor, including a control unit and a processing unit, and other circuitry, such as semiconductor hardware logic, that retrieves and executes software from the storage system. The processing system can be implemented within a single processing device but can also be distributed across multiple processing devices or sub-systems that cooperate according to existing program instructions. The processing system can include one or many software modules comprising sets of computer executable instructions for carrying out various functions as described herein.

As used herein, the term "control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A control module may include memory (shared, dedicated, or group) that stores code executed by the processing system. The term "code" may include software, firmware, and/or microcode, and may refer to programs, routines, functions, classes, and/or objects. The term "shared" means that some or all code from multiple control modules may be executed using a single (shared) processor. In addition, some or all code from multiple control modules may be stored by a single (shared) memory. The term "group" means that some or all code from a single control module may be executed using a group of processors. In addition, some or all code from a single control module may be stored using a group of memories.

The storage system can comprise any storage media readable by the processing system and capable of storing software. The storage system can include volatile and non-volatile, removable and non-removable media implemented in any method or technology for storage of information, such as computer-readable instructions, data structures, software program modules, or other data. The storage system can be implemented as a single storage device or across multiple storage devices or sub-systems. The storage system can include additional elements, such as a memory controller capable of communicating with the processing system. Non-limiting examples of storage media include random access memory, read-only memory, magnetic discs, optical discs, flash memory, virtual and non-virtual memory, various types of magnetic storage devices, or any other medium which can be used to store the desired information and that may be accessed by an instruction execution system. The storage media can be a transitory storage media or a non-transitory storage media such as a non-transitory tangible computer readable medium.

The control module 36 communicates with one or more components of the marine propulsion system 12 via the I/O interfaces and a communication link, which can be a wired or wireless link. The control module 36 is capable of monitoring and controlling one or more operational characteristics of the marine propulsion system 12 and its various subsystems by sending and receiving control signals via the communication link. In one example, the communication link is a controller area network (CAN) bus, but other types of links could be used. It should be noted that the extent of connections of the communication link shown herein is for schematic purposes only, and the communication link in fact provides communication between the control module 36 and each of the peripheral devices noted herein, although not every connection is shown in the drawing for purposes of clarity.

The marine propulsion system 12 also includes a control console 38 having a number of user-operated input devices in signal communication with the control module 36. For instance, the control console 38 includes a multi-functional input device 40 having a user interface 42 including traditional (e.g., keypad) or screen-generated buttons that can be used to select of a number of operating modes of the vessel 10 and/or to input vessel movement commands. The control console 38 further includes a joystick 44 that is tiltable and rotatable to provide vessel movement commands to the control module 36. For instance, the handle of the joystick 44 can be tilted away from its resting vertical orientation in order to request movement of the vessel 10 in any of a forward, reverse, starboard, port and/or combined (e.g., diagonal) direction. Additionally, the handle or knob of the joystick 44 can be rotated about the handle axis in order to request rotation (yaw) of the vessel 10. As known to those having ordinary skill in the art, the handle of the joystick 44 can be rotated at the same time that it is tilted in order to request both rotation and translation of the vessel 10 at the same time. The control console 38 further includes a steering wheel 46 for inputting directional steering commands to the control module 36 and a throttle lever 48 for inputting engine gear and speed commands to the control module 36. A start/stop button 50 is also provided at the control console 38 and is in signal communication with the control module 36 for sending a command to start or stop the engine 16 of the engine-powered propulsion device 14.

It is known to operate the vessel 10 in a thruster-only mode after initiating such mode via a user input at the control console 38. For example, the operator of the vessel 10 can make a selection via the user interface 42 or a separate thruster-only mode button to enable such a thruster-only mode. In this mode, only the non-engine-powered propulsion devices 24, 30 are powered to move the vessel 10 according to commands input via one of the user input devices, such as, for example, the joystick 44, or forward, aft, port, and starboard arrow buttons provided at the user interface 42. In such a thruster-only mode, the engine 16 is off, and inputs to the steering wheel 46 and the throttle level 48 are ignored. The thruster-only mode can be disabled by way of a selection made via the user interface 42 or the separate thruster-only mode button.

Additionally, it is known to operate the marine propulsion system 12 in a mode in which both the engine-powered propulsion device 14 and the non-engine-powered propulsion devices 24, 30 are actuated at the same time and/or in varying combinations in order to carry out requested movements of the vessel 10. For example, if a user input device such as the joystick 44 is manipulated in order to request both translation and rotation of the vessel 10, the engine-powered propulsion device 14 can be powered to provide a thrust via the propeller 22, while a rudder or other steerable component is rotated to change a direction of the vessel 10. (In the event that the engine-powered propulsion device 14 is a steerable propulsion device, the engine-powered propulsion device 14 itself could be rotated to change the direction of thrust from the propeller 22.) At the same time, one or both of the non-engine-powered propulsion devices 24, 30 are actuated to provide thrust to rotate the vessel 10 in the requested direction. By way of various combinations of thrusts provided by the engine-powered propulsion device 14 and one or both of the non-engine-powered propulsion devices 24, 30, many different movements of the vessel 10 can be accomplished, as is known to the those having ordinary skill in the art. Additionally, even more complex maneuvers may be carried out if the vessel 10 is equipped with two or more steerable engine-powered propulsion devices in addition to the non-engine-powered propulsion devices 24, 30.

During research and development, the present inventors realized that when the vessel 10 is being used to retrieve a skier, surfer, or swimmer from the water or to provide the person in the water with a towing rope, it is undesirable to have the engine 16 running while approaching the person in the water. This is because engine exhaust noise makes communication between the person in the water and the operator of the vessel 10 difficult; the person in the water may be anxious that the operator may accidentally place the engine 16 in gear; and/or there is a potential to lose sight of the person in the water due to any wake produced by the engine-powered propulsion device 14. Although initiation of the thruster-only mode in order to maneuver near the person in the water is possible, this requires that the operator of the vessel 10 select a specific button at the control console 38 or maneuver through a number of screens/options via the user interface 42 on the multi-functional input device 40. The present inventors therefore recognized that a need existed for automatically allowing use of only the non-engine-powered propulsion devices 24, 30 upon stopping the vessel 10 to retrieve a person in the water. Accordingly, the present disclosure provides a way that a user-operated input device other than a separate thruster-only mode button can be used to enable the non-engine-powered propulsion devices 24, 30 while the engine 16 is turned off. This allows the operator to enter the thruster-only mode much more quickly with fewer required steps.

Figure 2:
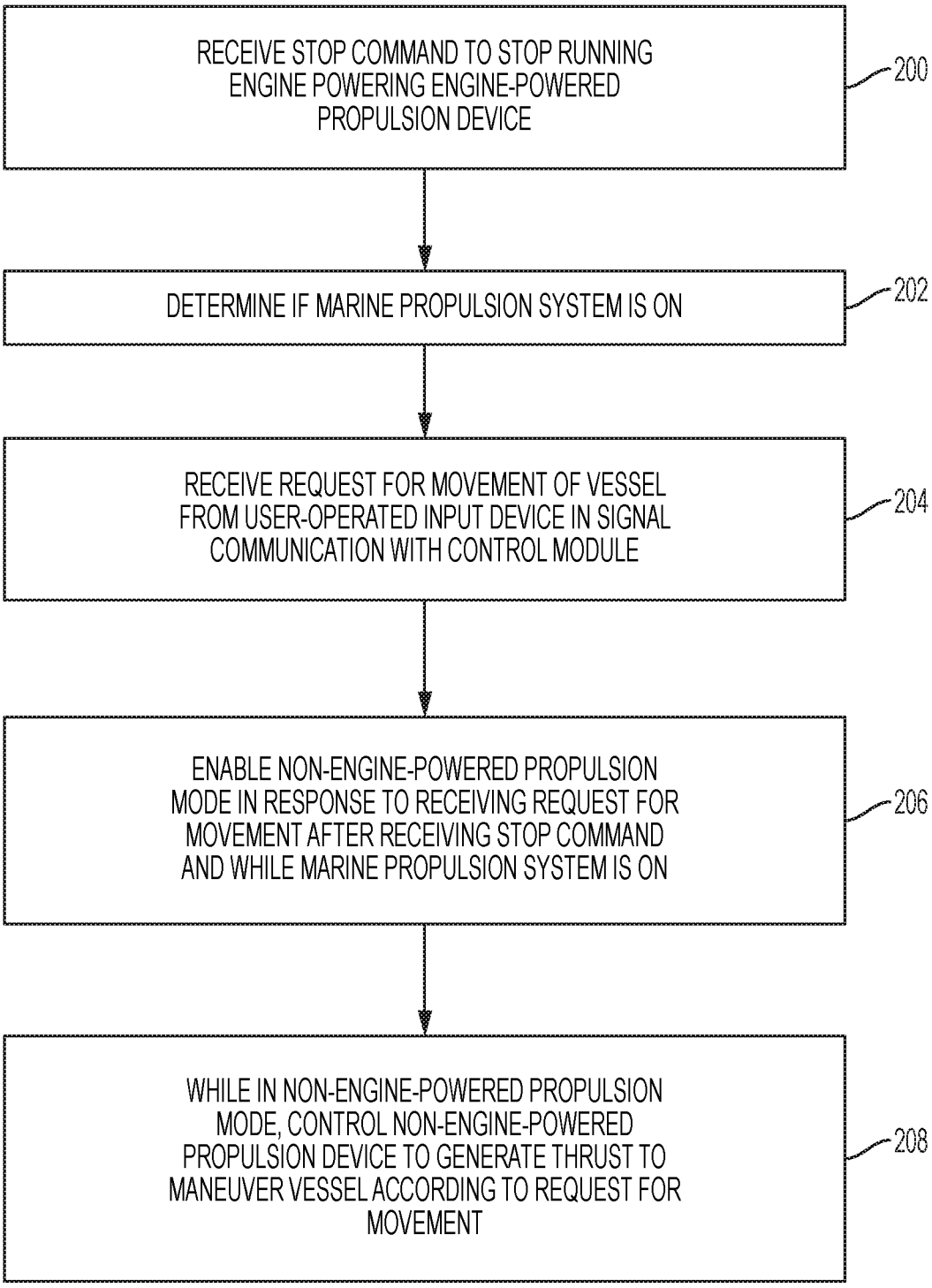
FIG. 2 illustrates a method for maneuvering the marine vessel according to the present disclosure.

Turning to FIG. 2, according to the present disclosure, a method for maneuvering a marine vessel 10 powered by marine propulsion system 12 including an engine-powered propulsion device 14 and a non-engine-powered propulsion device 24, 30 includes the following. As shown at 200, receiving a stop command to stop a running engine 16 powering the engine-powered propulsion device 14. As shown at 202, determining if the marine propulsion system 12 is on. As shown at 204, receiving a request for movement of the vessel 10 from a user-operated input device (e.g., joystick 44 or buttons on user interface 42) in signal communication with a control module 36 that carries out the method. As shown at 206, enabling a non-engine-powered propulsion mode in response to receiving the request for movement after receiving the stop command and while the marine propulsion system 12 is on. As shown at 208, while in the non-engine-powered propulsion mode, controlling the non-engine-powered propulsion device 24, 30 to generate thrust to maneuver the vessel 10 according to the request for movement. This method and further embodiments will be described below.

For example, the marine propulsion system 12 may operate in the non-engine-powered propulsion mode in response to the control module 36 determining the following: the engine 16 was previously running; a speed of the engine 16 is below an engine-stopped speed threshold; the marine propulsion system 12 is on; and a request for movement of the vessel 10 has been input via the user-operated input device. While the marine propulsion system 12 operates in the non-engine-powered propulsion mode, the control module 36 controls the non-engine-powered propulsion device 24, 30 to generate thrust to maneuver the vessel 10 according to the request for movement.

Figure 3:
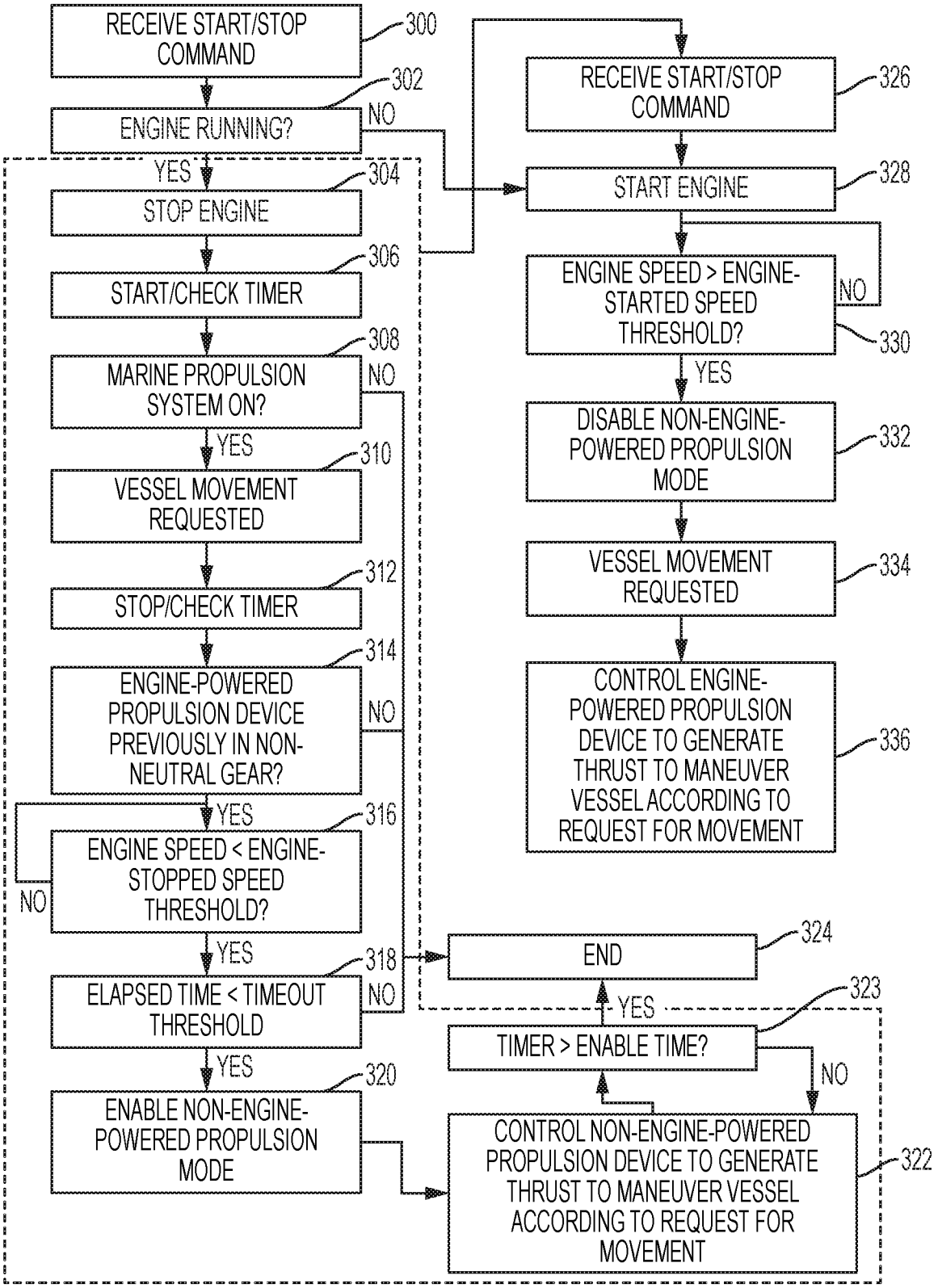
FIG. 3 illustrates control logic used by a control module to carry out methods according to the present disclosure.

FIG. 3 illustrates a logic diagram that the control module 36 may use to carry out a method of the present disclosure. The method begins at 300, when a start/stop command is received. The start/stop command may be initiated by actuation of the start/stop button 50 (FIG. 1) or by turning the key clockwise in the ignition from an already ON position. The marine propulsion system 12 may operate in the non-engine-powered propulsion mode (see 320) in response to the control module 36 determining that the start/stop button 50 is actuated or the key is turned clockwise from the ON position while the engine 16 is running, as shown at 302. If the engine is running (yes at 302) the control module 36 will relay the command to stop the engine 16, as shown at 304. In contrast, if the engine 16 is not running at 302, the control module 36 will start the engine 16, as shown at 328, in response to receiving the start/stop command at 300. In other words, actuation of the start/stop button 50 will switch the on/off state of the engine 16. Whether the engine 16 is currently running or stopped can be determined by way of a reading from an engine-speed measuring device, such as a tachometer.

At the time the control module 36 receives the start/stop command at 300 and/or relays the command to stop the engine 16 (which command is received at the engine 16 at 304), the control module 36 will also start a timer or check a continuously running timer, as shown at 306. As shown at 308, the control module 36 will also determine if the marine propulsion system 12 is on. The marine propulsion system 12 will remain on so long as the key in the ignition remains in the ON position. In other words, pressing of the start/stop button 50 does not turn the marine propulsion 12 system off. Note that the determination regarding whether the marine propulsion system is on at 308 need not be made after the timer is started/checked, but could be made at any time after the start/stop command is received at 300. If the marine propulsion system 12 is not on, i.e. the key in the ignition is in the OFF position, the method ends at 324. In this instance, the marine propulsion system 12 is off, and no thrust can be generated by either the non-engine-powered propulsion devices 24, 30 or the engine-powered propulsion device 14.

If the marine propulsion system 12 is still on (yes at 308), the control module 36 determines if vessel movement has been requested, as shown at 310. Such requested movement can be input by rotation and/or tilting of the joystick 44 or by selection of fore/aft/port/starboard buttons on the user interface 42. In response to vessel movement being requested at 310, the control module 36 stops or checks the timer that was started or checked at 306, as shown at 312. Thus, the control module 36 measures an amount of time that elapses between receiving the stop command (which was relayed at 304) and receiving the request for movement of the vessel 10 at 310. In one example, the timer may only be stopped while vessel movement is requested. Alternatively, the timer may not be stopped at all, and the elapsed time since the engine 16 was stopped may be checked constantly.

The control module 36 may also determine if the engine-powered propulsion device 14 was previously in a non-neutral gear, as shown at 314. For example, the control module 36 may determine if the transmission 20 was in forward gear, reverse gear, or more generally "in gear" by way of a previous signal from a gear state sensor. If no, the method ends at 324. If yes at 314, the method proceeds to 316 for eventual enablement of the non-engine-powered propulsion mode. Note that the determination at 314 could be made instead of the determination at 302, and the control module 36 may proceed with the method for enabling the non-engine-powered propulsion mode in response to determining that the engine-powered propulsion device 14 was previously in a non-neutral gear, but without determining that the engine 16 had previously been running. However, requiring both that the engine 16 was previously running and that the engine 16 was previously in gear will prevent engagement of the non-engine-powered propulsion mode at key-up, while the vessel 10 is docked and has not yet been operated in open water, or if the joystick 44 is accidently bumped. For example, the control module 36 may enable the non-engine-powered propulsion mode in response to determining that the engine-powered propulsion device 14 was previously in the non-neutral gear while the engine 16 was previously running. Alternatively, the control module 36 may determine if the engine 16 had previously been running and if the engine-powered propulsion device 14 was previously in a non-neutral gear, but might not require that these things were true simultaneously in order to enable the non-engine-powered propulsion mode.

At 316, the control module 36 may receive a measured speed of the engine 16 after receiving the stop command (see 300) and may enable the non-engine-powered propulsion mode in response to determining that the measured engine speed is less than a predetermined engine-stopped speed threshold. If no at 316, the control module 36 returns and waits until the measured engine speed is less than the engine-stopped speed threshold. The engine speed may be determined from the tachometer, as is known. The engine-stopped speed threshold may be calibrated and saved in the memory of the control module 36, and in one example is on the order of 50-100 RPM. In this way, the non-engine-powered propulsion mode may be enabled even before waiting for the engine 16 to stop completely. In another example, however, the engine-stopped speed threshold may be 0 RPM.

If the determination at 316 is yes, the control module 36 proceeds to 318, where it enables the non-engine-powered propulsion mode in response to determining that the elapsed amount of time between when the timer was started/checked at 306 and stopped/checked at 312 is less than a predetermined timeout threshold. The predetermined timeout threshold may also be a calibrated value saved in the memory of the control module 36, and may be, for example, on the order of three to five minutes. If no at 318, the method ends at 324. Thus, the method includes disabling the non-engine powered propulsion mode in response to determining that the elapsed amount of time is greater than the predetermined timeout threshold. This ensures that the non-engine-powered propulsion mode is only available for a limited period of time after the engine 16 has been stopped, while the operator is still at the control console 38 and in the mindset that inputs to the input devices might still result in vessel movement despite the engine 16 being stopped. If yes at 318, the method proceeds to 320, and the control module 36 finally enables the non-engine-powered propulsion mode. Thereafter, as shown at 322, the control module 36 controls the non-engine-powered propulsion devices 24, 30 to generate thrust to maneuver the vessel 10 according to the request for movement input via the user-operated input device, while the engine 16 remains off. In one example, the non-engine-powered propulsion mode will only remain enabled for a predetermined amount of time. Thus, the control module 36 may compare an enable time to an elapsed time since the stop command was input or relayed, since the engine 16 stopped, or since the non-engine-powered propulsion mode was enabled, as shown at 323. If the elapsed time exceeds the enable time at 323, then the method ends at 324, and the marine propulsion system 12 can no longer operate in the non-engine-powered propulsion mode until it is re-enabled. The enable time may be the same as or different from the timeout threshold, depending on programming.

Note that some of the steps and determinations shown in FIG. 3 may be optional, or may be carried out in any logical order other than that shown herein. For example, the determination as to whether the elapsed time is less than the timeout threshold may be made at any time after the timer is stopped/checked at 312. (As noted herein above, the timer may only be stopped while vessel movement is requested, or the timer may not be stopped at all and the elapsed time checked constantly.) By way of another example, determinations 314 and 316 could be switched, or determination 314 could be made at the same time as determination 302. In still another example, the timer might be stopped or checked (step 312) in response to the engine speed dropping below the engine-stopped speed threshold (step 316), such that the control module 36 considers the engine 16 to be "stopped." In other words, the marine propulsion system 12 may operate in the non-engine-powered propulsion mode in response to the control module 36 determining that an elapsed amount of time between the engine speed dropping below the engine-stopped speed threshold and input of the request for movement of the vessel is less than the predetermined timeout threshold. Thus, the arrangement of the logic shown herein is not limiting on the scope of the present disclosure, unless logic would dictate otherwise.

At any time, the control module 36 will disable the non-engine-powered propulsion mode in response to receiving a command to turn the marine propulsion system 12 off. For example, if the key is turned to the OFF position, the non-engine-powered propulsion mode will be disabled. Afterwards, once the key is turned back to the ON position and the marine propulsion system 12 is restarted, the marine propulsion system 12 will operate in a traditional engine-powered operating mode, such that movement of the joystick 44 or other user-operated input device will result in propulsion from both the engine-powered propulsion device 14 and non-engine-powered propulsion devices 24, 30, until the non-engine-powered propulsion mode is thereafter re-enabled.

As noted hereinabove, the control module 36 may receive the stop command in response to actuation of the start/stop button 50 in signal communication with the control module 36. Previously, such actuation of the start/stop button 50 was described with respect to a condition in which the engine 16 was already running. However, after the stop command is received and relayed to the engine 16, as shown at 304, the control module 36 may then receive a start command to start the engine 16. Thus, after any of steps or determinations 304-322, if the control module 36 receives a start/stop command while the engine 16 is stopped, as shown at 326, the control module 36 will start the engine 16, as shown at 328. The control module 36 will also disable the non-engine-powered propulsion mode in response to receiving the start command. First, as shown at 330, the control module 36 may receive a measured speed of the engine 16 after receiving the start command, and may disable the non-engine-powered propulsion mode in response to determining that the measured engine speed is greater than a predetermined engine-started speed threshold. If no at 330, the control module 36 may return and wait until the measured engine speed exceeds the engine-started speed threshold. In one example, the engine-started speed threshold is greater than the engine-stopped speed threshold used at 316, in order to provide hysteresis to the control module's logic.

If yes at 330, the method proceeds to 332, and the control module 36 disables the non-engine-powered propulsion mode. In the event that vessel movement is thereafter requested, as shown at 334, the control module 36 will control the engine-powered propulsion device 14 to generate thrust to maneuver the vessel 10 according to the request for movement, as shown at 336. Operation at 336 is effectively operation in the traditional operation mode, and may also include provision of thrust from the non-engine-powered propulsion devices 24 and 30; however, the engine 16 remains on during this mode.

Thus, the above-noted method provides automatic engagement of an operating mode in which the non-engine-powered propulsion devices 24 and 30 are used alone, while the engine 16 is off, so long as one or more of the above-noted conditions is met. This allows an operator of the vessel 10 to maneuver the vessel 10 near a person in the water almost immediately after stopping the engine 16, in order to come closer to the person in the water without fear that the engine will accidentally be placed in gear, and without the noisiness of the engine 16 being present.

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible within the scope of the appended claims. Each limitation in the appended claims is intended to invoke interpretation under 35 USC § 112(f), only if the terms "means for" or "step for" are explicitly recited in the respective limitation.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A marine propulsion system for a marine vessel, the marine propulsion system comprising:

an engine-powered propulsion device coupled in torque-transmitting relationship with an engine;

a non-engine-powered propulsion device coupled to a source of electric or hydraulic power;

a control module in signal communication with the engine-powered propulsion device and the non-engine-powered propulsion device; and a user-operated input device in signal communication with the control module;

wherein the marine propulsion system operates in a non-engine-powered propulsion mode in response to the control module determining the following:

the engine was previously running;

a speed of the engine is below an engine-stopped speed threshold;

the marine propulsion system is on; and a request for movement of the vessel has been input via the user-operated input device; and wherein while the marine propulsion system operates in the non-engine-powered propulsion mode, the control module controls the non-engine-powered propulsion device to generate thrust to maneuver the vessel according to the request for movement.

2. The marine propulsion system of claim 1, wherein the user-operated input device is a joystick.

3. The marine propulsion system of claim 1, wherein the non-engine-powered propulsion device is a bow or stern thruster.

4. The marine propulsion system of claim 1, wherein the engine-powered propulsion device is an inboard motor.

5. The marine propulsion system of claim 1, wherein the marine propulsion system operates in the non-engine-powered propulsion mode in response to the control module determining that the engine-powered propulsion device was previously in a non-neutral gear.

6. The marine propulsion system of claim 1, wherein the marine propulsion system operates in the non-engine-powered propulsion mode in response to the control module determining that an elapsed amount of time between the engine speed dropping below the engine-stopped speed threshold and input of the request for movement of the vessel is less than a predetermined timeout threshold; and wherein the control module disables the non-engine powered-propulsion mode in response to determining that the elapsed amount of time is greater than the predetermined timeout threshold.

7. The marine propulsion system of claim 1, wherein the control module disables the non-engine-powered propulsion mode in response to receiving a command to start the engine.

8. The marine propulsion system of claim 7, wherein the control module disables the non-engine-powered propulsion mode in response to determining that the engine speed is greater than a predetermined engine-started speed threshold.

9. The marine propulsion system of claim 1, further comprising a start/stop button in signal communication with the control module, wherein the marine propulsion system operates in the non-engine-powered propulsion mode in response to the control module determining that the start/stop button is actuated while the engine is running.

10. The marine propulsion system of claim 1, wherein the engine-stopped speed threshold is 0 RPM.

11. A method for maneuvering a marine vessel powered by a marine propulsion system including an engine-powered propulsion device coupled in torque-transmitting relationship with an engine and a non-engine-powered propulsion device coupled to a source of electric or hydraulic power, the method being carried out by a control module in signal communication with the engine-powered propulsion device and the non-engine-powered propulsion device, the method comprising:

operating in a non-engine-powered propulsion mode in response to determining the following:

the engine was previously running;

a speed of the engine is below an engine-stopped speed threshold;

the marine propulsion system is on; and a request for movement of the vessel has been input via a user-operated input device in signal communication with the control module; and controlling the non-engine-powered propulsion device to generate thrust to maneuver the vessel according to the request for movement while the marine propulsion system operates in the non-engine-powered propulsion mode.

12. The method of claim 11, wherein the user-operated input device is a joystick.

13. The method of claim 11, wherein the non-engine-powered propulsion device is a bow or stern thruster.

14. The method of claim 11, wherein the engine-powered propulsion device is an inboard motor.

15. The method of claim 11, further comprising operating the marine propulsion system in the non-engine-powered propulsion mode in response to determining that the engine-powered propulsion device was previously in a non-neutral gear.

16. The method of claim 11, further comprising operating the marine propulsion system in the non-engine-powered propulsion mode in response to determining that an elapsed amount of time between the engine speed dropping below the engine-stopped speed threshold and input of the request for movement of the vessel is less than a predetermined timeout threshold; and disabling the non-engine powered-propulsion mode in response to determining that the elapsed amount of time is greater than the predetermined timeout threshold.

17. The method of claim 11, further comprising disabling the non-engine-powered propulsion mode in response to receiving a command to start the engine.

18. The method of claim 17, further comprising disabling the non-engine-powered propulsion mode in response to determining that the engine speed is greater than a predetermined engine-started speed threshold.

19. The method of claim 11, further comprising operating the marine propulsion system in the non-engine-powered propulsion mode in response to determining that a start/stop button in signal communication with the control module is actuated while the engine is running.

20. The method of claim 11, wherein the engine-stopped speed threshold is 0 RPM.

* * * * *